US006240845B1

(12) United States Patent
Koppelkamm

(10) Patent No.: US 6,240,845 B1
(45) Date of Patent: Jun. 5, 2001

(54) DEVICE FOR FASTENING FLEXIBLE PRINTING PLATES

(75) Inventor: Günter Koppelkamm, Neuensalz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/395,114

(22) Filed: Sep. 14, 1999

(30) Foreign Application Priority Data

Sep. 14, 1998 (DE) ..... 198 41 912

(51) Int. Cl.[7] ..... B41F 1/28; B41F 21/00; B41F 13/10; B41F 37/06

(52) U.S. Cl. ..... 101/415.1; 101/378

(58) Field of Search ..... 101/378, 415.1, 101/407.1

(56) References Cited

U.S. PATENT DOCUMENTS

| | | | |
|---|---|---|---|
| 3,408,933 | 11/1968 | Hermach et al. | 101/415.1 |
| 5,423,258 | 6/1995 | Weber | 101/415.1 |

FOREIGN PATENT DOCUMENTS

| | | | |
|---|---|---|---|
| 2 711 095 | 10/1994 | (FR) | B41F/27/12 |
| 1 274 180 | 5/1972 | (GB) | B41F/27/12 |
| 2 010 182 | 6/1979 | (GB) | B41F/27/12 |

*Primary Examiner*—Kimberly Asher
(74) *Attorney, Agent, or Firm*—Cohen, Pontani, Lieberman & Pavane

(57) ABSTRACT

A device for fastening flexible printing plates to a plate cylinder of rotary printing machines having a channel in the plate cylinder which accommodates bent ends of the printing plate. A bore in the channel is axially parallel to the plate cylinder and has two segmented shafts arranged pivotably therein. Leaf springs are each fastened to the segmented shafts and can be brought into contact with the ends of the printing plate inserted into the channel. A region radially connects the bore to a channel gap on the periphery of the plate cylinder. The channel has lateral recesses at a distance from the channel gap and, the approximately rectangularly bent ends of the printing plate are equipped with shaped elements which project into the channel in the direction of the recesses. The shaped elements of one or both ends inserted into the channel can be moved into the recesses by bringing the respective leaf springs into contact while bending the ends.

5 Claims, 3 Drawing Sheets

DEVICE FOR FASTENING FLEXIBLE PRINTING PLATES

BACKGROUND OF THE INVENTION

1. Field of the Invention

The invention relates to rotary printing machines, and more particularly to a device for fastening flexible printing plates within rotary printing machines.

2. Description of the Related Art

DD 261 765 A1 describes a device for fastening flexible printing plates to a plate cylinder or rotary printing machines. A channel in the plate cylinder accommodates the bent ends of the printing plate. A bore in the channel, which is axially parallel to the plate cylinder, has two segmented shafts arranged pivotably therein. Leaf springs which are each fastened to the segmented shafts can be brought into contact with the ends inserted into the channel. The segmented shafts are mounted in the bore in the channel via a hollow shaft which is cut out for the leaf springs. The leading end of the ends which are bent at different acute angles depending on the direction of rotation of the plate cylinder is clamped directly by the leaf springs against an oblique channel side wall, and the trailing end is clamped between the leaf springs and a clamping bar fastened to the hollow shaft. This device depends on the direction of rotation, has a relatively wide channel opening on the periphery of the plate cylinder due to the double mounting of the segment shafts in the bore, requires a correspondingly high outlay, and is not suitable for the use of a device for automated printing-plate changing.

SUMMARY OF THE INVENTION

An object of the present invention is to provide a device for fastening flexible printing plates to a plate cylinder which secures the ends of the printing plate in the channel, even at a high speed of revolution of the plate cylinder, and ensures a printing-plate change which looks after the printing plate in the sense of its recyclability. It is another object to provide a device for fastening flexible printing plates to a plate cylinder that is simply constructed, is not susceptible to faults, can be used irrespective of the direction of rotation of the plate cylinder and is suitable for automatic printing-plate change.

This and other objects of the invention achieved by securing the bent ends of the printing plate against slipping out of the channel by means of a positive and frictional connection produced by the interaction of the shaped elements, recesses and the leaf springs, even at a high circumferential speed of the plate cylinder. Because of its radially symmetrical construction, the device according to the invention can be used irrespective of the direction rotation with respect to the plate cylinder, and in conjunction with the rectangularly bent ends of the printing plate. Since the insertion and withdrawal of both ends always takes place at the same angle, namely at right angles to the plate cylinder, and does not require any change in the direction of rotation of the latter the device of the present invention is suitable for automatic printing-plate changing. In addition, the printing plate is not damaged during the changing operation, ensuring its multiple use.

The interaction during a printing-plate change of shaped elements having a relatively low height, together with the recesses in the channel, makes possible a narrow channel gap on the periphery of the plate cylinder which benefits the printing process by minimizing channel impacts. Finally, the direct arrangement of the segmented shafts in the bore of the channel ensures a simple construction of the device, and the indirect support of the segmented shafts via supporting elements in conjunction with the large clearance between the segmented shafts and the bore, ensures low susceptibility to faults with regard to the mobility of the mechanisms as a result of contamination getting into the channel.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention will be explained in more detail using an exemplary embodiment. In the associated drawings.

DETAILED DESCRIPTION OF THE PRESENTLY PREFERRED EMBODIMENTS

Figure 1:
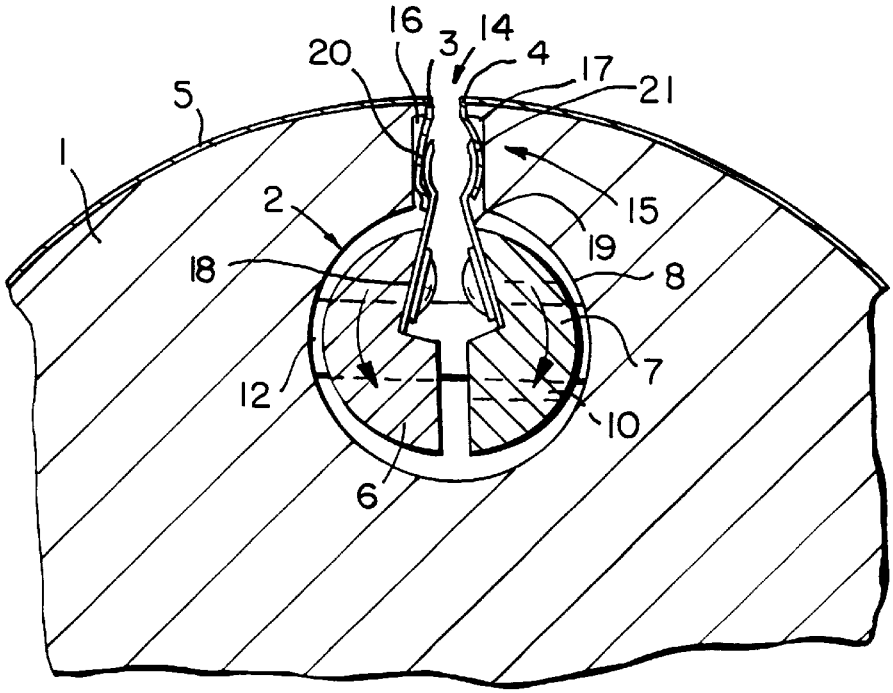
FIG. 1 is a cross sectional view of the device according to an embodiment of the invention with a printing plate fastened on a plate cylinder.
Figure 5:
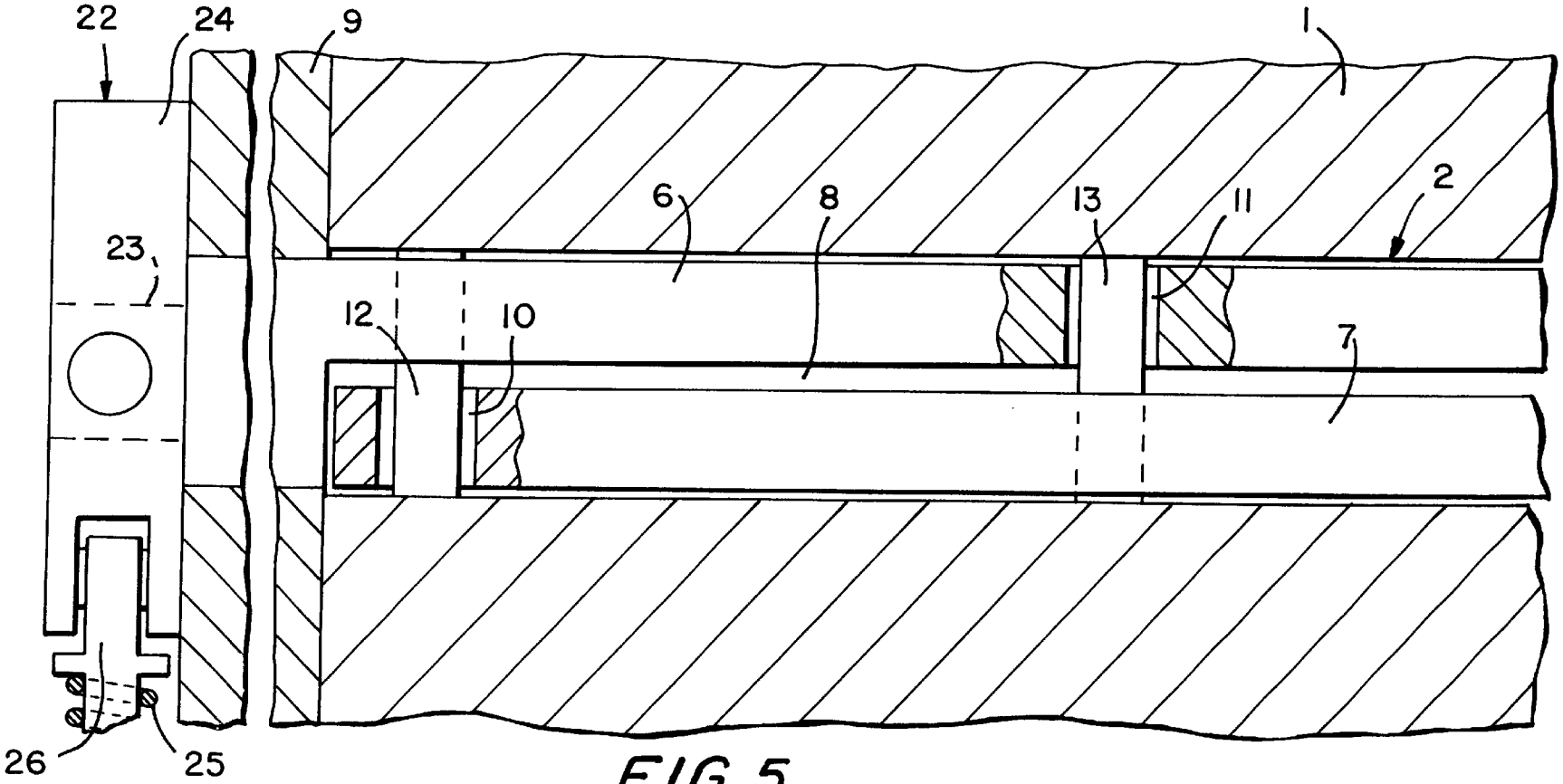
FIG. 5 is a longitudinal section of the device according to FIG. 1.

FIG. 1 shows a detail of a plate cylinder 1 having a channel 2 running in its longitudinal direction, in which the inserted ends 3, 4, bent approximately at a right angle, of a flexible printing plate 5 are fastened. For this purpose, two segmented shafts 6, 7 are pivotably arranged in a bore 8 in the channel 2. The segmented shafts 6, 7 are in each case mounted laterally on one side in the plate cylinder 1 or in a Schmitz (bearer) ring 9 (FIG. 5) firmly connected to the latter. Segmented shafts 6, 7 are laterally mounted on one side in a region in the bore 8 which reaches over the other segmented shaft 7 or 6, and are supported against the wall of the bore 8 by means of at least one supporting element 12 or 13 which passes through the other segmented shaft 7 or 6 in a recess 10 or 11 with a clearance needed for the pivoting action (FIG. 5).

The channel 2 has a region 15 which connects the bore 8 to a channel gap 14 on the periphery of the plate cylinder 1 in the radial direction of the plate cylinder and, at a distance radially from the periphery of the plate cylinder 1, is equipped with recesses 16, 17 which extend as far as the bore (FIG. 1).

Fastened to the segment shafts 6, 7, which are cut out for the purpose, are leaf springs 18, 19 which reach into the region of the recesses 16, 17. The ends of leaf springs 18, 19 engage in an appropriately fittingly deformed manner in shell-like shaped elements 20, 21, of the bent ends 3, 4, each projecting in the direction of the recesses 16, 17 of the printing plate. When shell-like elements 20, 21 are brought into contact, they bend the ends 3, 4 into the respective recesses 16, 17, effecting a combined positive and frictional connection in the channel 2.

Figure 2:
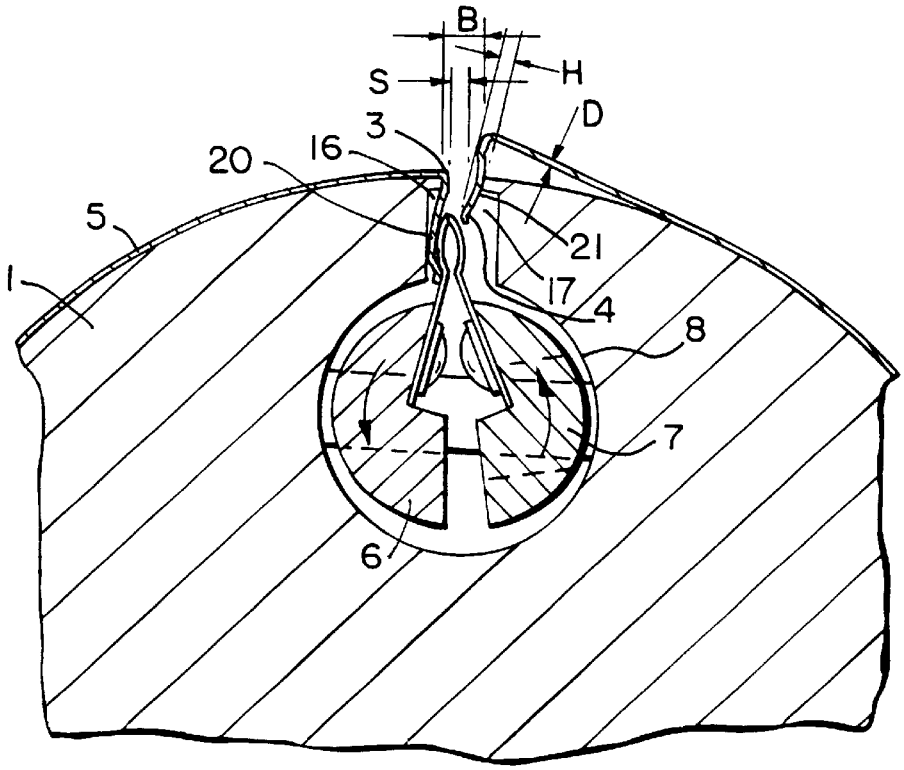
FIG. 2 is a cross-sectional view according to FIG. 1 during the insertion of a second bent end of the printing plate into a channel in the plate cylinder.
Figure 3:
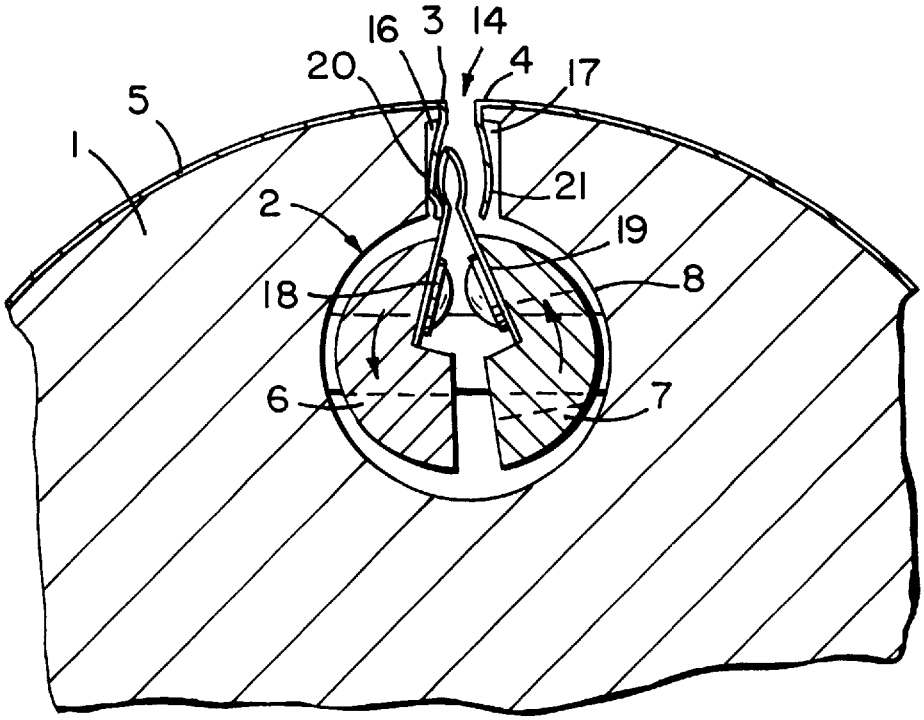
FIG. 3 is a cross-sectional view according to FIG. 1 before the clamping of the inserted second end of the printing plate in the channel.

FIG. 2 shows the insertion of the second bent end 4 of the printing plate 5 into the channel 2 or its withdrawal from the latter. For this purpose, the segmented shaft 7 is pivoted in the counter-clockwise direction, so that the second end 4 can be inserted into the channel 2, past the leaf springs 19 resting on the leaf springs 18 of the other segmented shaft 6. FIG. 3 shows the second end 4 completely inserted into the channel 2 before it is clamped in the recess 7 by the leaf springs 19 by means of pivoting the segmented shaft 7 in the clockwise direction. The explanations relating to FIGS. 2 and 3 apply unrestrictedly to both ends 3, 4 of the printing plate 5.

Figure 4:
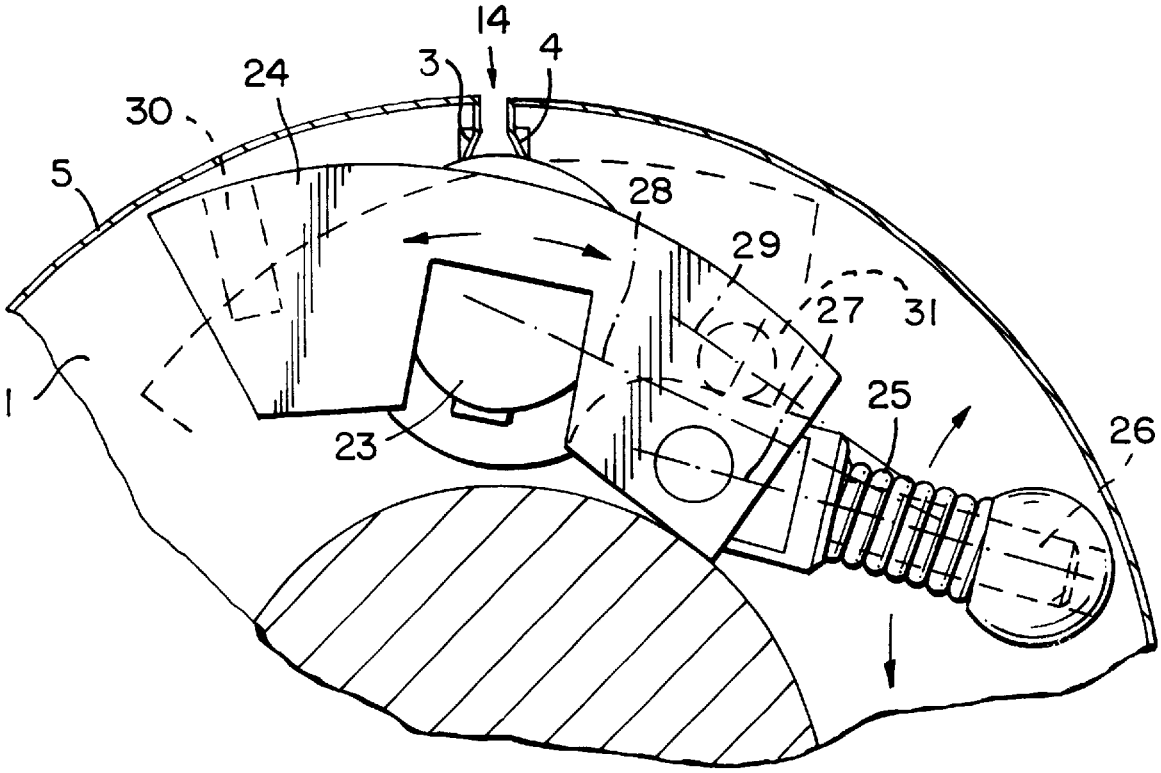
FIG. 4 is a detailed side view of the plate cylinder showing a moving mechanism for the device according to an embodiment of the invention.

FIGS. 4 and 5 show, in a manner representative of both segmented shafts 6, 7, a movement mechanism 22 for the segmented shaft 6. A lever 24 is fastened on a journal 23 of the segmented shaft 6 and is supported in the manner of a toggle lever, via a spring 25, against a pivoting support 26 mounted in the plate cylinder 1. The movement mechanism for the segmented shaft 7 is arranged in the same way on the other, non-illustrated side of the plate cylinder 5.

FIG. 4 shows the portion of the journal 23 and the lever 24 when the segmented shaft 6 with leaf springs 18 (see FIG. 3) is pivoted away from the bent end 3 of the printing plate 5. In order to clamp the end 3, the lever 24 is pivoted from this position 27, over the dead position 28 characterized by a stretched position of the lever 24 and pivoting support 26, into the position 29 which is illustrated by dashed lines. The segmented shafts 6 and 7 (see FIG. 5) are thus in each case automatically blocked in the positions 27, 29 by the toggle-lever effect. The lever 24 can be pivoted by means of an operating tool which can be inserted alternately into corresponding holes 30, 31.

Referring to FIG. 2, the channel gap 14 has a relatively low width B which is made up of the thickness D of the printing plate 5, the height H of a shaped element 21 of a bent end 4 of the printing plate 5, and a clearance S needed for the insertion of the second end 4 into the channel 2, this clearance being minimized by the lateral recesses 16, 17.

The invention is not limited by the embodiments described above which are presented as examples only but can be modified in various ways within the scope of protection defined by the appended patent claims.

I claim:

1. A device for fastening flexible printing plates to a plate cylinder of a rotary printing machine, wherein the plate cylinder has a channel for accommodating bent ends of the printing plate, the device comprising:

a bore in the channel and being axially parallel to the plate cylinder;

two segmented shafts pivotably arranged in said bore;

a channel gap on the plate cylinder adapted to receive the bent ends of the printing plate;

a region radially connecting said bore to said channel gap;

lateral recesses disposed within said region at a distance from said channel gap;

shaped elements formed on the bent ends of the printing plate which project in the channel in a direction of said recesses; and a leaf spring connected to each of said segmented shafts and being adapted to contact the bent ends of the printing plate inserted into the channel, wherein said shaped element of said ends of the printing plate can be moved into said recesses by bringing said leaf spring into contact with said bent ends after said ends are inserted into said channel gap, wherein said channel gap comprises a width, said width comprising of a thickness of the printing plate, a height of the shaped element of one end and a clearance needed for the insertion of the second bent end of the printing plate.

2. The device in accordance with claim 1, wherein said bent ends of the printing plate and engaging ends of said leaf springs are complimentary in shape.

3. The device in accordance with claim 1, further comprising:

a recess disposed in each of said two segmented shafts, wherein said two segmented shafts are each mounted at the ends of the plate cylinder coaxially opposite each other; and at least one supporting element disposed in said bore for supporting at least one of said two segmented shafts against a wall of said bore in a region which reaches over and passes through the recess in the other of said two segmented shafts, wherein a clearance required for pivoting said segmented shafts is provided opposite at least one of the two segmented shafts and adjacent the other of the two segmented shafts.

4. The device in accordance with claim 1, further comprising a movement mechanism for pivoting said segmented shafts by one side of each of the segmented shafts outside their mounting in the plate cylinder.

5. The device in accordance with claim 4, wherein said movement mechanism comprises:

a journal for the segmented shafts; and a lever fixedly arranged on said journal and being spring loaded and pivotable about a dead position to either side thereof, wherein movement of said lever in one direction brings said leaf springs into contact with said printing plate ends, and movement in an opposing direction brings said leaf springs out of contact with said printing plate ends.

* * * * *